US008751235B2

(12) United States Patent
Mori et al.

(10) Patent No.: US 8,751,235 B2
(45) Date of Patent: Jun. 10, 2014

(54) ANNOTATING PHONEMES AND ACCENTS FOR TEXT-TO-SPEECH SYSTEM

(75) Inventors: Shinsuke Mori, Kanagawa (JP); Toru Nagano, Kanagawa (JP); Masafumi Nishimura, Kanagawa (JP)

(73) Assignee: Nuance Communications, Inc., Burlington, MA (US)

( * ) Notice: Subject to any disclaimer, the term of this patent is extended or adjusted under 35 U.S.C. 154(b) by 667 days.

(21) Appl. No.: 12/534,808

(22) Filed: Aug. 3, 2009

(65) Prior Publication Data

US 2010/0030561 A1 Feb. 4, 2010

Related U.S. Application Data

(63) Continuation of application No. 11/457,145, filed on Jul. 12, 2006, now abandoned.

(30) Foreign Application Priority Data

Jul. 12, 2005 (JP) ..... 2005-203160
Jul. 10, 2006 (JP) ..... 2008-520863
Jul. 10, 2006 (WO) ..... PCT/EP2006/064052

(51) Int. Cl.
*G10L 13/08* (2013.01)
*G10L 13/10* (2013.01)

(52) U.S. Cl.
CPC ..... *G10L 13/08* (2013.01); *G10L 13/086* (2013.01); *G10L 13/10* (2013.01)
USPC ..... 704/258

(58) Field of Classification Search
CPC ..... G10L 13/08; G10L 13/086; G10L 13/10
USPC ..... 704/258–269
See application file for complete search history.

(56) References Cited

U.S. PATENT DOCUMENTS 4,896,359 A 1/1990 Yamamoto et al.
5,751,906 A * 5/1998 Silverman ..... 704/260

(Continued)

FOREIGN PATENT DOCUMENTS

EP 0 327 266 A2 8/1989
GB 2 292 235 A 2/1996

(Continued)

OTHER PUBLICATIONS

Ma et al. "Introduction to CKIP Chinese Word Segmentation System for the First International Chinese Word Segmentation Bakeoff", Proceedings of the second SIGHAN workshop on Chinese language processing, vol. 17, pp. 168-171, 2003.*

(Continued)

*Primary Examiner* — Jialong He
(74) *Attorney, Agent, or Firm* — Wolf, Greenfield & Sacks, P.C.

(57) ABSTRACT

A system that outputs phonemes and accents of texts. The system has a storage section storing a first corpus in which spellings, phonemes, and accents of a text input beforehand are recorded separately for individual segmentations of the words that are contained in the text. A text for which phonemes and accents are to be output is acquired and the first corpus is searched to retrieve at least one set of spellings that match the spellings in the text from among sets of contiguous spellings. Then, the combination of a phoneme and an accent that has a higher probability of occurrence in the first corpus than a predetermined reference probability is selected as the phonemes and accent of the text.

30 Claims, 9 Drawing Sheets

(56) References Cited

U.S. PATENT DOCUMENTS

| | | | | |
|---|---|---|---|---|
| 5,913,193 | A * | 6/1999 | Huang et al. | 704/258 |
| 6,029,132 | A * | 2/2000 | Kuhn et al. | 704/260 |
| 6,098,042 | A * | 8/2000 | Huynh | 704/260 |
| 6,173,263 | B1 * | 1/2001 | Conkie | 704/260 |
| 6,233,553 | B1 | 5/2001 | Contolini et al. | |
| 6,260,016 | B1 * | 7/2001 | Holm et al. | 704/260 |
| 6,266,637 | B1 * | 7/2001 | Donovan et al. | 704/258 |
| 6,363,342 | B2 | 3/2002 | Shaw et al. | |
| 6,411,932 | B1 * | 6/2002 | Molnar et al. | 704/260 |
| 6,640,006 | B2 * | 10/2003 | Wu et al. | 382/177 |
| 6,665,641 | B1 * | 12/2003 | Coorman et al. | 704/260 |
| 6,751,592 | B1 * | 6/2004 | Shiga | 704/258 |
| 6,778,962 | B1 * | 8/2004 | Kasai et al. | 704/266 |
| 6,879,951 | B1 * | 4/2005 | Kuo | 704/10 |
| 7,136,816 | B1 | 11/2006 | Strom | |
| 7,165,030 | B2 * | 1/2007 | Yi et al. | 704/238 |
| 7,280,963 | B1 * | 10/2007 | Beaufays et al. | 704/236 |
| 2002/0003898 | A1 * | 1/2002 | Wu | 382/187 |
| 2002/0099547 | A1 * | 7/2002 | Chu et al. | 704/260 |
| 2003/0191645 | A1 * | 10/2003 | Zhou | 704/260 |
| 2005/0071148 | A1 * | 3/2005 | Huang et al. | 704/4 |
| 2005/0182629 | A1 | 8/2005 | Coorman et al. | |
| 2005/0192807 | A1 | 9/2005 | Emam et al. | |
| 2007/0118356 | A1 * | 5/2007 | Badino | 704/10 |

FOREIGN PATENT DOCUMENTS

| | | |
|---|---|---|
| JP | S61-296396 | 12/1986 |
| JP | 2000-075585 | 3/2000 |
| JP | 2001-075585 | 3/2001 |
| JP | 2003-005776 | 1/2003 |

OTHER PUBLICATIONS

Xue, "Chinese Word Segmentation as Character Tagging", Computational Linguistics and Chinese Language Processing, vol. 8, No. 1, Feb. 2003.*

Boldea et al., "Design, Collection and Annotation of a Romanian Speech Database," Proceedings of First Int'l Conference on Language Resources and Evaluation—LREC—Workshop on Speech Database Development for Central and Eastern European Languages, Granada, Spain 1998, p. 1-4.

Examination Report for European Patent Application No. 06 764 122.5-1224 dated Aug. 25, 2008.

Examination Report for Japanese Patent Application No. 2008-520863 dated Sep. 16, 2008.

Ishida et al., "F0 Pattern Generation Using Statistic Model of Divisional Pattern," IEICE Technical Report, Oct. 19, 2000, vol. 100, No. 392, SP2000-68, p. 1-8.

Nagata, M., "A Stochastic Japanese Morphological Analyzer Using a Forward-DP Backward-*A** N-Best Search Algorithm," *Proc. Coling* p. 201-207 (1994).

Olinsky et al., "Iterative English Accent Adapatation in a Speech Synthesis System," Proceedings of 2002 IEEE Workshop on Speech Synthesis 2002, pp. 79-82.

Youssef et al., "An Arabic TTS System Based on the IBM Trainable Speech Synthesizer," Ile traitement automatique de l'arabe, JEPTALN Feb. 2004, p. 1-9.

Momosawa et al., "Accent Automated Estimation of Japanese Family Names Based Upon Statistic Models," Collected papers for presentation—I—at Meeting for Reading Research Papers in 2004, The Acoustical Society for Japan, Sep. 21, 2004, 3-2-17, pp. 349-350.

Canadian Office Action for Canadian Application No. 2614840 mailed Jun. 17, 2013.

International Search Report and Written Opinion for PCT Application No. PCT/EP2006/064052 mailed Oct. 11, 2006.

International Preliminary Report on Patentability for PCT Application No. PCT/EP2006/064052 mailed Jan. 24, 2008.

Nagano et al., A Stochastic Approach to Phoneme and Accent Estimation. Interspeech 2005. Sep. 4, 2005-Sep. 8, 2005. Lisbon, Portugal. 2005:3293-3296.

* cited by examiner

20

22

| Spelling w | *** | | | | *** | | *** | | |
|---|---|---|---|---|---|---|---|---|---|
| Part of speech t | | Proper noun | General noun | General noun | | Proper noun | | General noun | General noun |
| Phonemes s | *** | kyo : to | ta wa : | ho te ru | *** | kyo : to | *** | ta wa : | hoteru |
| Accent a | | L H HOO | H H H(Y) | H L LOO | | H L LOO | | H L LOO | H L LOO |

24

| Spelling | *** | | | *** | | | *** | | *** |
|---|---|---|---|---|---|---|---|---|---|
| Part of speech | | Proper | Proper | | Noun | Noun | | Verb | |
| Accent | *** | X | X | *** | Y | Y | *** | Z | *** |
| Phonemes | | kyo | to | | se | ka i | | no bo | |

FIG. 2

22

******ABC (noun,X)********

********DEF (verb, Y)********

******GHI (verb, X)********

********JKL (noun, X)********

******MNO (verb, Y)********

FIG. 6A

24

| Text Expression | *** | A B C | *** | D E F | *** | G H I | *** | J K L | *** | M N O | *** |
|---|---|---|---|---|---|---|---|---|---|---|---|
| Part of Speech | | Noun Noun Noun | | Verb Verb Verb | | Verb Verb Verb | | Noun Noun Noun | | Verb Verb Verb | |
| Accent | *** | X X X | *** | Y Y Y | *** | X X X | *** | X X X | *** | Y Y Y | *** |
| Phonemes | | a b c | | d e f | | g h i | | j k l | | m n o | |

FIG. 6B

ANNOTATING PHONEMES AND ACCENTS FOR TEXT-TO-SPEECH SYSTEM

CROSS-REFERENCE TO RELATED APPLICATIONS

This application is a continuation of and claims priority to, under 35 U.S.C. §120, application Ser. No. 11/457,145, filed Jul. 12, 2006, which claims priority, under 35 U.S.C. §119, to Japanese application no. 2005-203160, filed Jul. 12, 2005. Each of these applications is incorporated by reference herein in its entirety.

BACKGROUND OF THE INVENTION

The present invention relates to a system, a program, and a control method and, in particular, to a system, program, and control method which outputs the phonemes and accents of texts.

The ultimate goal of speech synthesis technology is to generate synthetic speech so natural that it cannot be distinguished from human utterance, or synthesized speech as accurate and clear as, or even more accurate and clearer than that of humans. Today's speech synthesis technology, however, has not yet reached the level of human utterance in all respects.

The basic factors that determine the naturalness and intelligibility of speech include phonemes and accent. Speech synthesis systems typically receive, as inputs, character strings (for example, a text containing kanji and hiragana characters in Japanese) and outputs speech. Processing for generating synthetic speech typically involves two steps: the first step called the front-end processing and the second step called back-end processing, for example.

In the front-end processing, the speech synthesis system performs processing for analyzing text. In particular, the speech synthesis system receives character strings as inputs, estimates word boundaries in the input character strings, and provides a phoneme and accent to each word. In the back-end processing, the speech synthesis system splices speech segments based on the phonemes and accents given to the words to generate actual synthetic speech.

A problem with conventional front-end processing is that the accuracy of phonemes and accents is not sufficiently high. Accordingly, unnatural-sounding synthetic speech can result. To solve this problem, techniques for providing as natural phonemes and accents as possible for input character strings have been proposed (see below).

A speech synthesizing apparatus described in Japanese Published Unexamined Patent Application No. 2003-5776 ("Patent Document 1") stores information about the spellings, phonemes, accents, parts of speech, and frequencies of occurrence of words for each spelling (see FIG. 3 of Patent Document 1). When more than one candidate word segmentations are requested, the sum of frequency information of each of the words in each candidate word segmentation is calculated and the candidate word segmentation that provides the largest sum is selected (see Paragraph 22 of Patent Document 1). Then, the phonemes and accent associated with the candidate word segmentation are output.

A speech synthesizing apparatus described in Japanese Published Unexamined Patent Application No. 2001-75585 ("Patent Document 2") generates a set of rules that determine the accent of phonemes of each morpheme on the basis of its attributes. Then, input text is split into morphemes, the attributes of each morpheme are input and the set of rules are applied to them to determine the accent of the phonemes.

Here, the attributes of a morpheme are the number of morae, part of speech, and conjugation of the morpheme as well as the number of morae, parts of speech, and conjugations of the morphemes that precede and follow it.

In the technique described in Patent document 1, candidate word segmentations are determined on the basis of the frequency information about each word, irrespectively of the context in which the word is used. However, in languages such as Japanese and Chinese in which word boundaries are not explicitly indicated, same spellings can be segmented into different multiple words which vary depending on the context and accordingly can be pronounced differently with different accents. Therefore, the technique cannot always determine appropriate phonemes and accents.

In the technique described in Patent document 2, determination of accents is as processing separate from determination of word boundaries or phonemes. This technique is inefficient because after an input text is scanned in order to determine phonemes and word boundaries, the input text must be scanned again in order to determine accents. According to the technique, training data is input to improve the accuracy of the set of rules used for determining accents. However, the set of rules are used only for determining accents, therefore the accuracy of determination of phonemes and word boundaries cannot be improved even if the amount of training data is increased.

BRIEF SUMMARY OF THE INVENTION

One exemplary aspect of the present invention is a system which outputs phonemes and accents of a text. The system includes a storage section which stores a first corpus in which spellings, phonemes, and accents of a text input beforehand are recorded for individual segmentations of words contained in the text. A text acquiring section acquires a text for which phonemes and accents are to be output. A search section retrieves at least one set of spellings that matches spellings in the text from among sets of contiguous sequences of spellings in the first corpus. A selecting section selects a combination of a phoneme and an accent that has a higher probability of occurrence in the first corpus than a predetermined reference probability from among combinations of phonemes and accents corresponding to the retrieved set of spellings.

Another exemplary aspect of the invention is a computer program embodied in computer readable memory which causes an information processing apparatus to function as a system which outputs phonemes and accents of a text. The computer program includes storage program code which stores a first corpus in which spellings, phonemes, and accents of a text input beforehand are recorded for individual segmentations of words contained in the text. Text acquiring program code acquires a text for which phonemes and accents are to be output. Search program code retrieves at least one set of spellings that matches spellings in the text from among sets of contiguous sequences of spellings in the first corpus. Selecting program code selects a combination of a phoneme and an accent that has a higher probability of occurrence in the first corpus than a predetermined reference probability from among combinations of phonemes and accents corresponding to the retrieved set of spellings.

Yet a further exemplary aspect of the invention is a control method for a system which outputs phonemes and accents of a text. The system includes a storage section which stores a first corpus in which spellings, phonemes, and accents of a text input beforehand are recorded separately for individual segmentations of words contained in the text. The method includes acquiring a text for which phonemes and accents are to be output. A retrieving operation retrieves at least one set of spellings that matches spellings in the text from among sets of contiguous sequences of spellings in the first corpus. A selecting operation selects a combination of a phoneme and an accent that has a higher probability of occurrence in the first corpus than a predetermined reference probability from among combinations of phonemes and accents corresponding to the retrieved set of spellings The summary of the invention given above does not enumerate all of essential features of the present invention. Subcombinations of the features also constitute the present invention.

BRIEF DESCRIPTION OF THE SEVERAL VIEWS OF THE DRAWINGS

FIG. 2 shows an exemplary data structure in a storage section;

FIG. 6 shows an example of generation of exceptive words and a second corpus;

DETAILED DESCRIPTION OF THE INVENTION

Figure 1:
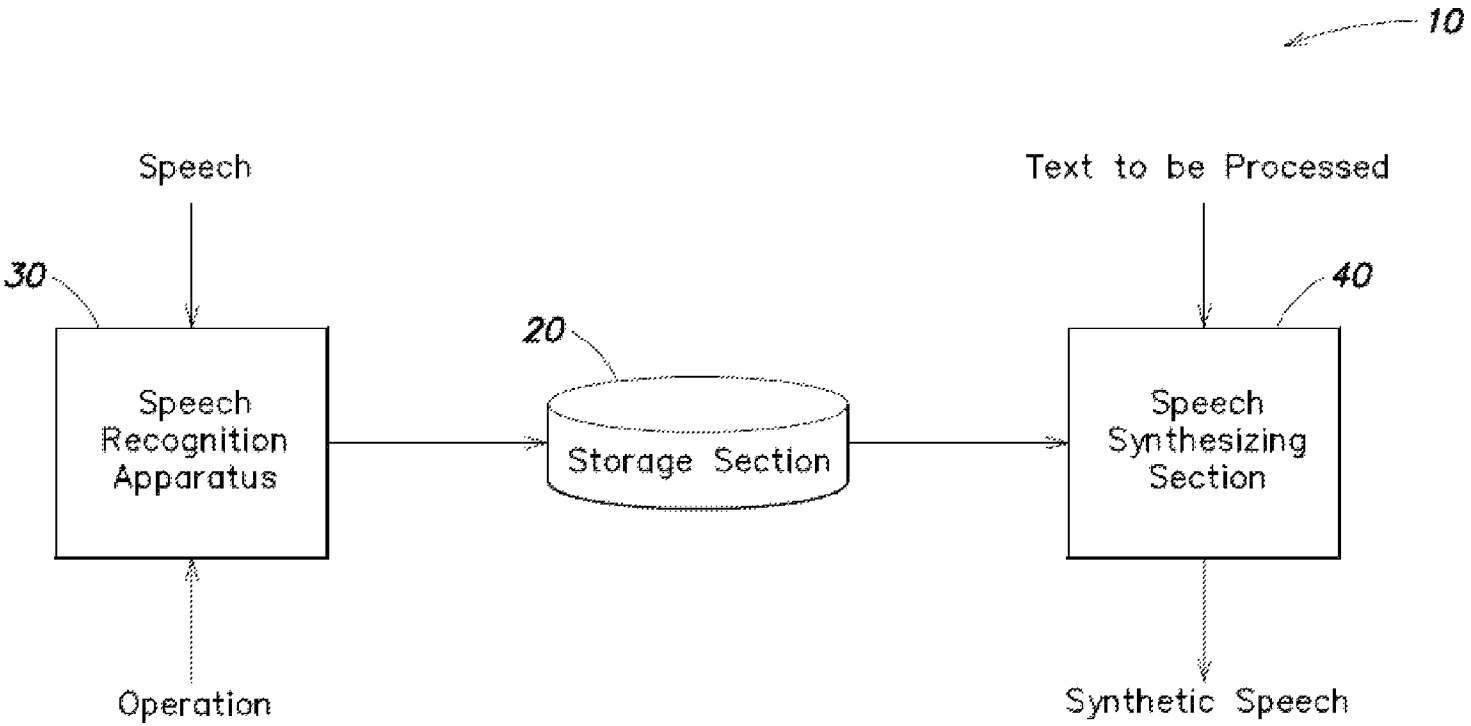
FIG. 1 shows an overall configuration of a speech processing system.

According to the present invention, natural-sounding phonemes and accents can be provided for text. The present invention will be described with respect to embodiments thereof. However, the embodiments described below do not limit the present invention defined in the claims and not all combinations of features described in the embodiments are not necessarily requisites for the solution according to the present invention.

As will be appreciated by one skilled in the art, the present invention may be embodied as a method, system, or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (anon-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to the Internet, wireline, optical fiber cable, RF, etc.

Computer program code for carrying out operations of the present invention may be written in an object oriented programming language such as Java, Smalltalk, C++ or the like. However, the computer program code for carrying out operations of the present invention may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present invention is described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

FIG. 1 shows an overall configuration of a speech processing system 10. The speech processing system 10 includes a storage section 20, a speech recognition apparatus 30, and a speech synthesizing apparatus 40. The speech recognition apparatus 30 recognizes speech uttered by a user to generate text. The speech recognition apparatus 30 stores the generated text in the storage section 20 in association with phonemes and accents based on the recognized speech. The text stored in the storage section 20 is used as a corpus for speech synthesis.

When the speech synthesizing apparatus 40 acquires a text for which phonemes and accents are to be output, the speech synthesizing apparatus 40 compares the text with the corpus stored in the storage section 20. The speech synthesizing apparatus 40 then selects the combinations of phonemes and accents for the multiple words in the text that have the highest probability of occurrence from the corpus. The speech synthesizing apparatus 40 generates synthetic speech based on the selected phonemes and accents and outputs it.

According to the present embodiment, the speech processing system 10 selects a phoneme and an accent of a text to be processed for each set of spellings that contiguously appear in the corpus on the basis of the probabilities of occurrence of combinations of the phonemes and accents for the set. The purpose of doing this is to select phonemes and accents in consideration of the context of words in addition to the probabilities of occurrence of the words themselves. The corpus used for the speech synthesis can be automatically generated using speech recognition techniques, for example. The purpose of doing so is to save labor and costs required for the speech synthesis.

FIG. 2 shows an exemplary data structure of the storage section 20. The storage section 20 stores a first corpus 22 and a second corpus 24. In the first corpus 22, spellings, part of speech, phonemes, and accents of a preinput text are recorded for individual segmentations of words contained in the text. For example, in the first corpus 22 in the example shown in FIG. 2, a text "京都タ is segmented into spellings "京都" "タワー", and "ホテ and these are recorded in this order. Also in the first corpus 22, spellings "京都", "タワー", , and "ホテ are recorded separately for another context.

The first corpus 22 stores the spelling "京都" in association with information indicating that the word in the expression is a proper noun, the phonemes are "Kyo : to", and the accent is "LHH". Here, the colon ":" represents a prolonged sound and "H" and "L" represent high-pitch and low-pitch accent elements, respectively. That is, the first syllable of the word "京都" is pronounced as "Kyo" with low-pitch accent, the second syllable "o :" with high-pitch accent, and the third syllable "to" with high-pitch accent.

On the other hand, the word "京都" appearing in another context is stored in association with the accent "HLL", which differs from the accent of the word "京都" in the text "京都タワーホテル". Similarly, word "タワー" is associated with the accent "HHH" in the text "京都タワーホテル". but with the accent "HLL" in another context. In this way, the phonemes and accent of each word that are used in the context in which the word appears are recorded, rather than a univocal phoneme and accent of the word.

Accents are represented by "H"s and "L"s that indicate the high and low pitches, respectively, in FIG. 2 for convenience of explanation. However, accents may be represented by identifiers of predetermined types into which patterns of accents are classified. For example, "LHH" may be represented as type X and "HHH" may be represented as type Y, and the first corpus 22 may record these accent types.

The speech synthesizing apparatus 40 may be used in various applications. Various kinds of text such as those in E-mail, bulletin boards, Web pages as well as draft copies of newspapers or books can be input in the speech synthesizing apparatus 40. Therefore, it is not realistic to record all words that can appear in every text to be processed in the first corpus 22. The storage section 20 also stores the second corpus 24 so that the phonemes of a word in a text to be processed that does not appear in the first corpus 22 can be appropriately determined.

In particular, recorded in the second corpus 24 is a phoneme of each of the characters contained in words in the first corpus 22 that are to be excluded from comparison with words in a text to be processed. Also recorded in the second corpus 24 are the part of speech and accent of each character in words to be excluded. For example, if the word "京都" in the text "京都タワーホテル" is a word to be excluded, the second corpus 24 records the phonemes "kyo" and "to" of the characters "京" and "都", respectively, contained in the word "京都", in association with the respective characters. The word "京都" is a noun and its accent is of type X. Accordingly, the second corpus 24 also records information indicating that the part of speech, noun, and the accent type, X, in association with the characters "京" and "都", respectively.

The provision of the second corpus 24 enables the phonemes of the word "京都" to be determined properly by combining the phonemes of the characters "京" and "都" even if the word "京都" is not recorded in the first corpus 22.

The first corpus 22 and/or second corpus 24 may also records the beginning and end of texts and words, new lines, spaces and the like as symbols for identifying the context in which a word is used. This information enables phonemes and accents to be assigned more precisely.

The storage section 20 may also store information about phonemes and prosodies required for speech synthesis in addition to the first corpus 22 and the second corpus 24. For example, the speech recognition apparatus 30 may generate prosodic information that is an association of the phonemes of a word recognized through speech recognition with information about phonemes and prosodies that are to be used when the phonemes are actually spoken, and may store the prosodic information in the storage section 20. In this case, the speech synthesizing apparatus 40 may select phonemes of a text to be processed, then generate phonemes and prosodies of the selected phonemes on the basis of the prosodic information, and output them as synthesized speech.

Figure 3:
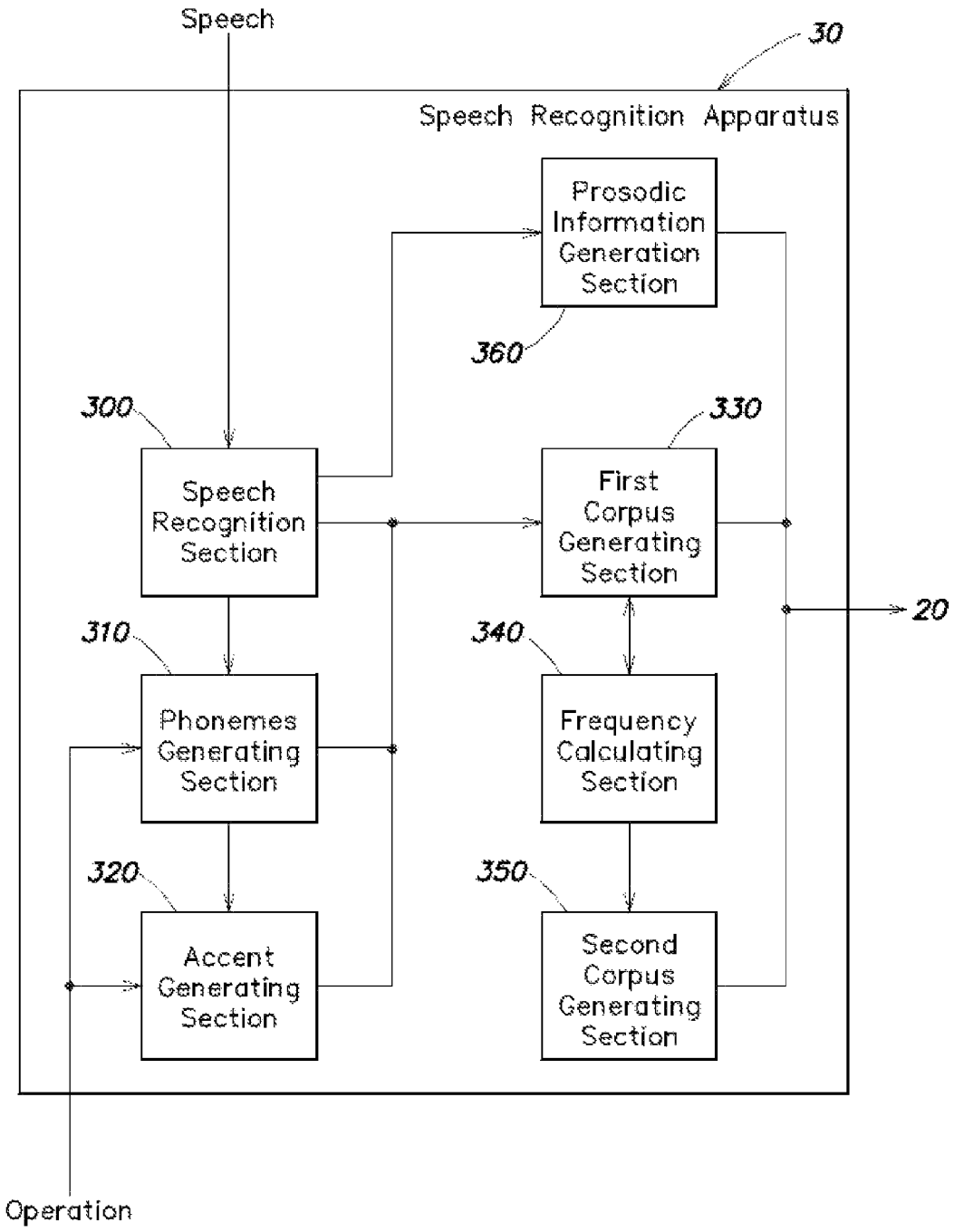
FIG. 3 shows a functional configuration of a speech recognition apparatus.

FIG. 3 shows a functional configuration of the speech recognition apparatus 30. The speech recognition apparatus 30 includes a speech recognition section 300, a phoneme generating section 310, an accent generating section 320, a first corpus generating section 330, a frequency calculating section 340, a second corpus generating section 350, and a prosodic information generating section 360. The speech recognition section 300 recognizes speech to generate a text in which spellings are recorded separately for individual word segmentations. The speech recognition section 300 may generate data for each word in the recognized text, in which the part of speech of the word is associated with the word. Furthermore, the speech recognition section 300 may correct the text in accordance with a user operation.

The phonemes generating section 310 generates a phoneme of each word in a text on the basis of speech acquired by the speech recognition section 300. The phonemes generating section 310 may correct the phonemes in accordance with a user operation. The accent generating section 320 generates an accent of each word on the basis of speech acquired by the speech recognition section 300. Alternatively, the accent generating section 320 may accept an accent input by a user for each word in a text.

The first corpus generating section 330 records a text generated by the speech recognition section 300 in association with phonemes generated by the phonemes generating section 310 and accents input from the accent generating section 320 to generate a first corpus 22 and stores it in the storage section 20. The frequency calculating section 340 calculates the frequencies of occurrence of sets of spellings, phonemes, and accents that appear in the first corpus. The frequency of occurrence is calculated for each set of a spelling, phonemes, and accent, rather than for each spelling. For example, if the frequency of occurrence of the spelling "京都" is high but the frequency of occurrence of the spelling "京都" with the accent "LHH" is low, then the low frequency of occurrence will result in association with the set of the spelling and the accent.

The first corpus generating section 330 records in the first corpus 22 sets of spellings, phonemes, and accents having frequencies of occurrence lower than a predetermined criterion as words to be excluded. The second corpus generating section 350 records each of the characters contained in each word to be excluded, in the second corpus 24 in association with the phonemes with the character. The prosodic information generating section 360 generates, for each word contained in a text recognized by the speech recognition section 300, prosodic information indicating the prosodies and phonemes of the word, and stores the prosodic information in the storage section 20.

The first corpus generating section 330 may generate, for each of sets of spellings appearing in sequence in the first corpus 22, a language model indicating the number or frequency of occurrences of the phonemes and accents in the set of spellings in the first corpus 22 and may store the language model in the storage section 20, instead of storing the first corpus 22 itself in the storage section 20. Similarly, the second corpus generating section 350 may generate, for each of sets of characters appearing in sequence in the second corpus 24, a language model indicating the number or frequency of occurrences of the phonemes of the set of characters in the second corpus 24, and may store the language model in the storage section 20, instead of storing the second corpus 24 itself in the storage section 20. The language models facilitate the calculation of the probabilities of occurrence of phonemes and accents in the corpuses, thereby improving the efficiency of processing from the input of a text to the output of synthetic speech.

Figure 4:
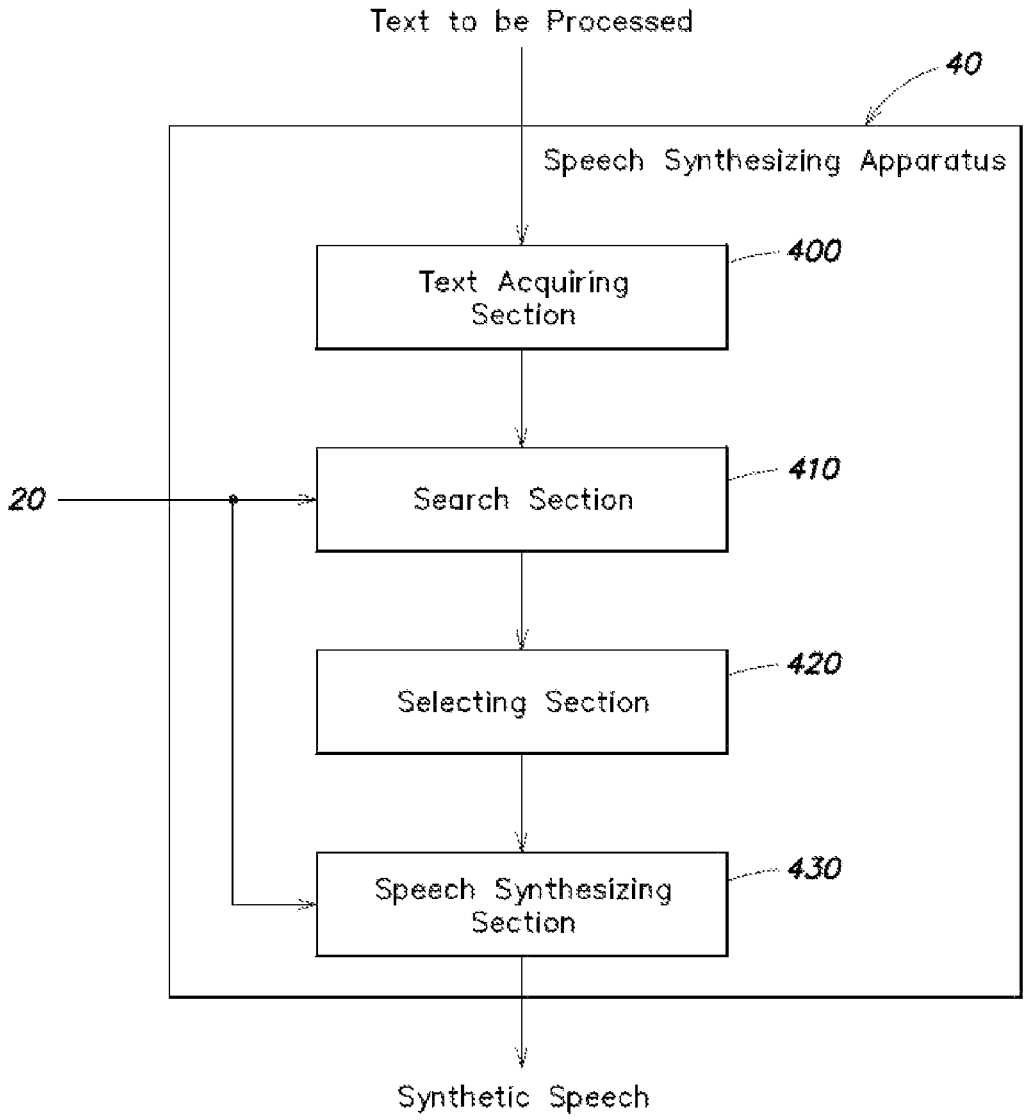
FIG. 4 shows a functional configuration of a speech synthesizing apparatus.

FIG. 4 shows a functional configuration of the speech synthesizing apparatus 40. The speech synthesizing apparatus 40 includes a text acquiring section 400, a search section 410, a selecting section 420, and a speech synthesizing section 430. The text acquiring section 400 acquires a text to be processed. The text may be written in Japanese or Chinese, for example, in which word boundaries are not explicitly indicated. The search section 410 searches the first corpus 22 to retrieve at least one set of spellings that matches spellings in the text from among the sets of spellings appearing in sequence in the first corpus 22. The selecting section 420 selects, from among the combinations of phonemes and accents corresponding to the set or sets of spellings retrieved, combinations of phonemes and accents that appear in the first corpus 22 more frequently than a predetermined reference probability frequency as the phonemes and accents of the text.

Preferably, the selecting section 420 selects the combination of a phoneme and accent that has the highest probability of occurrence. More preferably, the selecting section 420 selects the most appropriate combination of a phoneme and accent by taking into account the context in which the text to be processed appears. If a spelling that matches a spelling in the text to be processed is not found in the first corpus 22, the selecting section 420 may select a phoneme of the spelling from the second corpus 24. Then, the speech synthesizing section 430 generates synthetic speech on the basis of the selected phonemes and accents and outputs it. In doing so, it is desirable that the speech synthesizing section 430 use prosodic information stored in the storage section 20.

Figure 5:
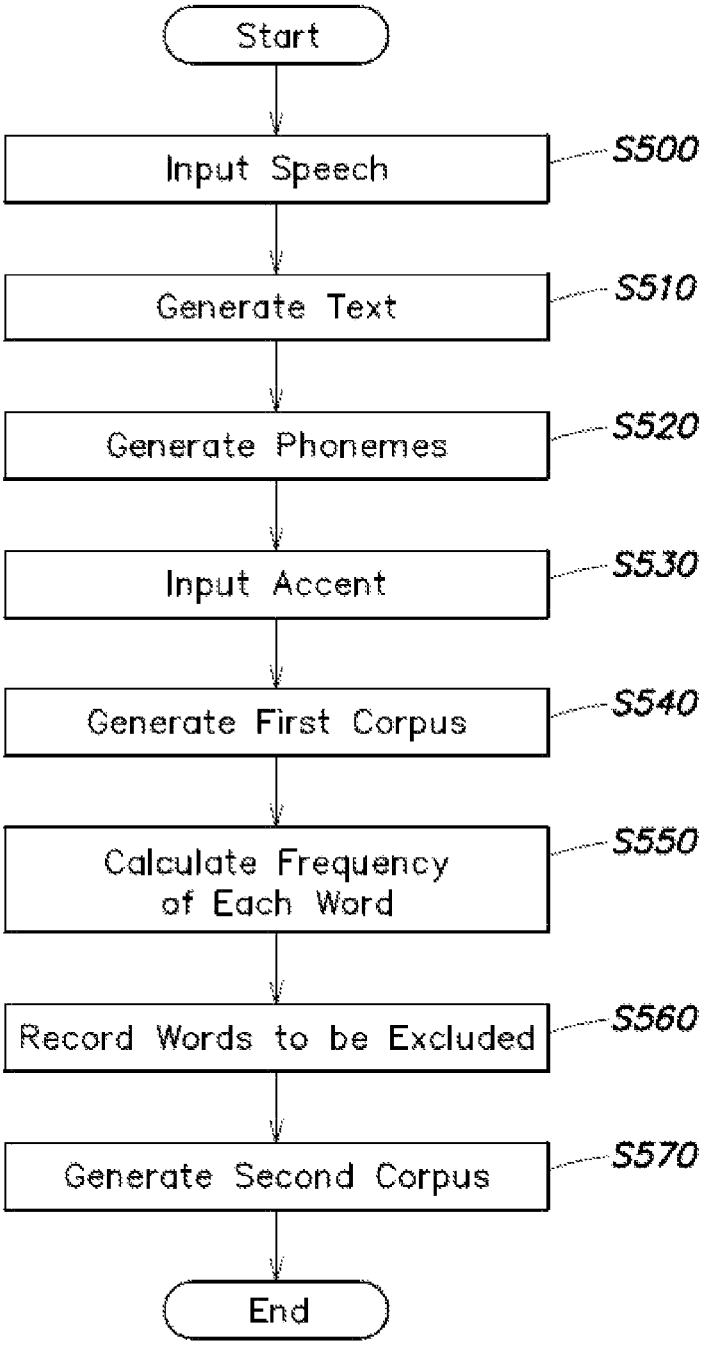
FIG. 5 shows an example of a process for generating a corpus using speech recognition.

FIG. 5 shows an example of a process for generating a corpus by using speech recognition. The speech recognition section 300 receives speech input by a user (S500). The speech recognition section 300 then recognizes the speech and generates a text in which spellings are recorded separately for individual word segmentations (S510). The phonemes generating section 310 generates a phoneme of each word in the text on the basis of the speech acquired by the speech recognition section 300 (S520). The accent generating section 320 obtains an input accent of each word in the text from a user (S530).

The first corpus generating section 330 generates a first corpus by recording the text generated by the speech recognition section 300 in association with the phonemes generated by the phonemes generating section 310 and the accents generated by the accent generating section 320 (S540). The frequency calculating section 340 calculates the frequencies of occurrences of sets of spellings, phonemes, and accents in the first corpus (S550). Then, the first corpus generating section 330 records in the first corpus 22 sets of spellings, phonemes, and accents that appear less frequently than a predetermined reference value as words to be excluded (S560). The second corpus generating section 350 records in the second corpus 24 each of the characters contained in each word to be excluded, in association with its phonemes (S570).

FIG. 6 shows an example of generation of words to be excluded and a second corpus. The first corpus generating section 330 detects sets of spellings, phonemes, and accents that have lower frequencies of occurrences than a predetermined reference value as words to be excluded. Focusing attention on words in the first corpus 22 that are to be excluded, processing performed for the words will be described in detail with respect to FIG. 6. As shown in FIG. 6 (*a*), the words "ABC", "DEF", "GHI", "JKL", and "MNO" are detected as words to be excluded. While the characters making up the words are represented abstractly by alphabetic characters in FIG. 6 for convenience of explanation, spellings of words in practice are made up of characters of the language to be processed in speech synthesis.

Spellings of words to be excluded are not compared with words in the text to be processed. Because these words result from conversion from speech to text by using a speech recognition technique for example, their parts of speech and accents are known. The part of speech and type of accent of each word to be excluded are recorded in the first corpus 22 in association with the word. For example, the part of speech "noun" and accent type "X" are recorded in the first corpus 22 in association with the word "ABC". It should be noted that the spelling "ABC" and the phonemes "abc" of the word to be excluded do not have to be recorded in the first corpus 22.

As shown in FIG. 6 (*b*), the second corpus generating section 350 records the characters contained in each word to be excluded in the second corpus 24 in association with their phonemes, parts of speech of the word, and types of accent of the word. In particular, because the word "ABC" is detected to be a word to be excluded, the second corpus 24 records the characters "A", "B", and "C" that constitute the word in association with their phonemes. In addition, the second corpus 24 classifies the phonemes of characters contained in each word to be excluded by sets of the part of speech and accent of the word to be excluded, and records them. For example, because the word "ABC" is a noun and the type of its accent is X, the character "A" that appears in the word "ABC" is associated and recorded with "noun" and "accent type X".

As in the first corpus 22, rather than recording a univocal phoneme of each character, a phoneme that is used in the word in which the character appears is recorded in the second corpus 24. For example, in the second corpus 24, the phoneme "a" may be recorded in association with the spelling "A" in the word "ABC" and, in addition, another phoneme may be recorded in association with the spelling "A" that appears in another word to be excluded.

The method for generating words to be excluded described with respect to FIG. 6 is only illustrative and any other method may be used for generating words to be excluded. For example, words preset by an engineer or a user may be generated as words to be excluded and may be recorded in the second corpus.

Figure 7:
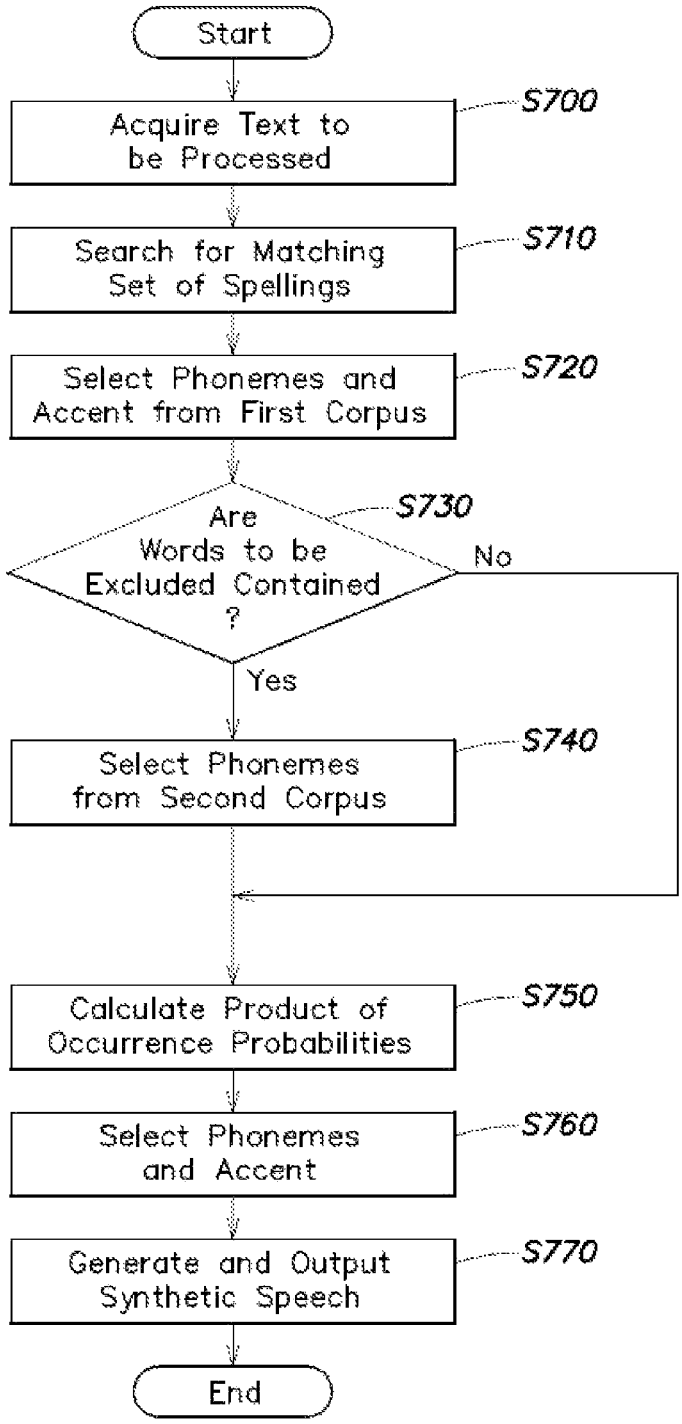
FIG. 7 shows an example of a process for selecting phonemes and accents of text to be processed.

FIG. 7 shows an example of a process for selecting phonemes and accents for a text to be processed. The text acquiring section 400 acquires a text to be processed (S700). The search section 410 searches through the sets of spellings that appear in sequence in the first corpus 22 to retrieve all sets of spellings that match the spellings in the text to be processed (S710). The selecting section 420 selects all combinations of phonemes and accents that correspond to the retrieved sets of spellings from the first corpus 22 (S720).

At step S710, the search section 410 may search the first corpus 22 to retrieve sets of spellings that match the text, except for the words to be excluded, in addition to the sets of spellings that perfectly match the spellings in the text. In that case, the selecting section 420 selects from the first corpus 22 all combinations of phonemes and accents of the retrieved sets of spellings including the words to be excluded at step 720.

If the retrieved set of spellings contains a word to be excluded (S730: YES), the search section 410 searches the second corpus 24 for a set of characters that match the characters in the partial text out of the text to be processed that corresponds to the word to be excluded (S740). Then the selecting section 420 obtains the probability of occurrence of each combination of a phoneme and accent of the retrieved set of spellings including the word to be excluded (S750). The selecting section 420 also calculates, for the partial text, the probability of occurrence of each of the combinations of phonemes of sets of characters retrieved from the characters corresponding to the parts of speech and accents of the word to be excluded in the second corpus 24. The selecting section 420 then calculates the product of the obtained probabilities of occurrence and selects the combination of a phoneme and accent that provides the largest product (S760).

If the sets of spellings retrieved at step S710 do not include words to be excluded (S730: NO), the selecting section 420 may calculate the probability of occurrence of each of the combinations of phonemes and accents of the retrieved sets of spellings (S750), and may select the set of a phoneme and accent that has the highest probability of occurrence (S760). Then, the speech synthesizing section 430 generates synthetic speech on the basis of the selected phonemes and accents and outputs the speech (S770).

It is preferable that the combination of a phoneme and accent that has the highest probability of occurrence be selected. Alternatively, any of the combinations of phonemes and accents that have occurrence probabilities higher than a predetermined reference probability may be selected. For example, the selecting section 420 may selects a combination of a phoneme and an accent that has a occurrence probability higher than a reference probability from among the combinations of phonemes and accents of the retrieved sets of spellings including words to be excluded. Furthermore, the selecting section 420 may select a combination of phonemes that has an occurrence probability higher than another reference probability from among the combinations of phonemes of the sets of characters retrieved for the partial text that corresponds to a word to be excluded. With this processing, the phonemes and accents can be determined with a certain degree of precision.

Preferably, not only the probabilities of occurrence obtained for one given text to be processed but also the probabilities of occurrence obtained for the texts that precede and follow the text are used to select a set of a phoneme and accent at step S760. One known example of this processing is a technique called the stochastic model or n-gram model (see Nagata, M., "A stochastic Japanese morphological analyzer using a Forward-DP Backward-A* N-Best search algorithm," Proceedings of Coling, pp. 201-207, 1994 for details). A process in which the present embodiment is applied to a 2-gram model, which is one type of n-gram model, will be described below.

Figure 8:
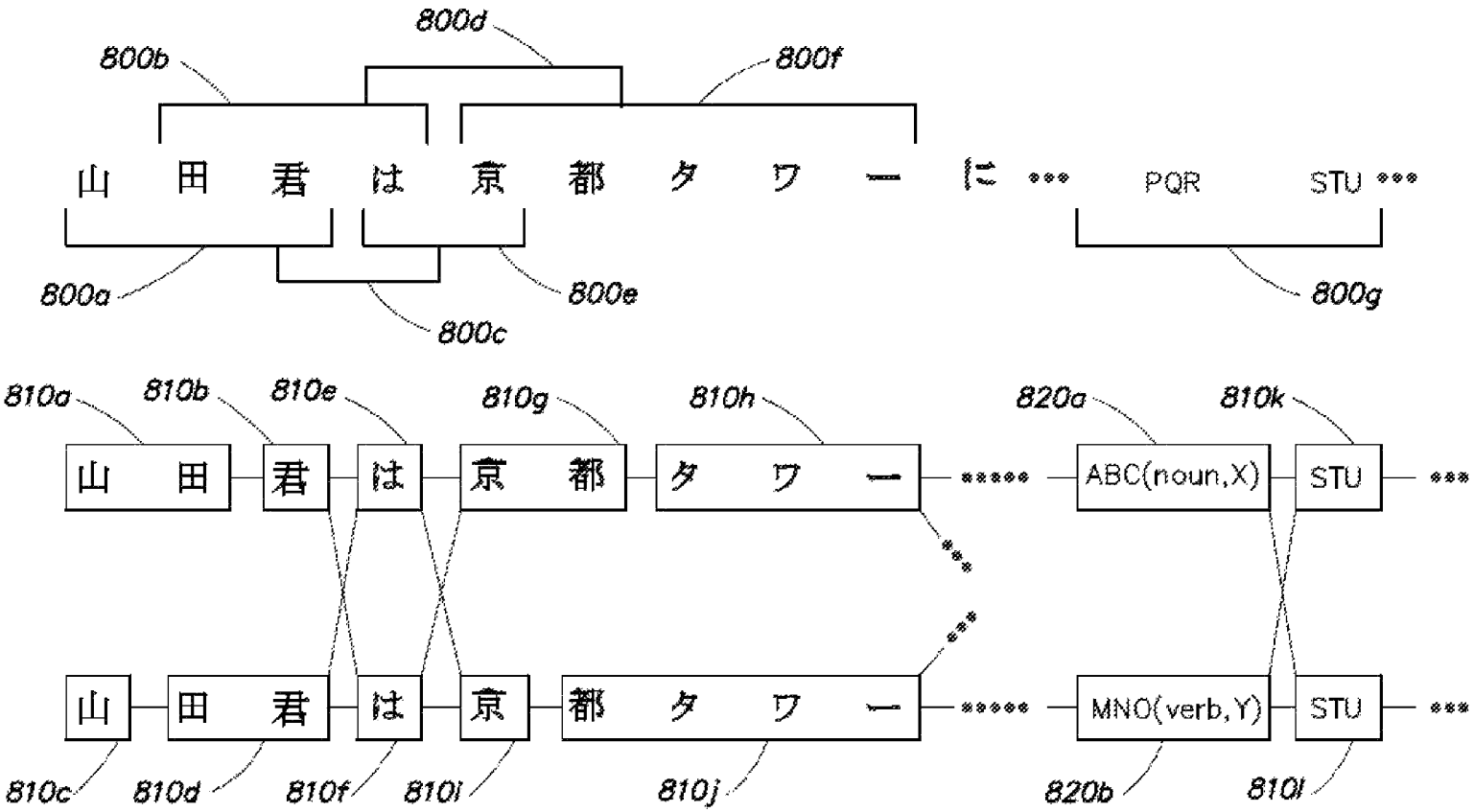
FIG. 8 shows an example of a process for selecting phonemes and accents using a stochastic model.

FIG. 8 shows an example of a process for selecting phonemes and accents by using a stochastic model. In order for the selecting section 420 to select phonemes and accents at step S760, the selecting section 420 preferably uses the probabilities of occurrence obtained for multiple texts to be processed as described in FIG. 8. The process will be described below in detail. First, the text acquiring section 400 inputs a text including multiple texts to be processed. For example, the text may be "山田君は京都タワー . . . ABC . . . ". In this text, boundaries of the text to be processed are not explicitly indicated.

A case will be first described where a text to be processed matches a set of spellings that does not include words to be excluded.

The text acquiring section 400 selects the portion "山 from the text as a text to be processed 800*a*. The search section 410 searches through sets of contiguous sequences of spellings in the first corpus 22 for a set of spellings that match the spelling of the text to be processed 800*a*. For example, if the word 810*a* "山田" and the word 810*b* "君" are recorded contiguously, the search section 410 searches for the words 810*a* and 810*b*. Furthermore, if the word 810*c* "山" and the word 810*d* "田君" are recorded contiguously, the search section 410 searches for the words 810*c* and 810*d*.

Here, the spelling "山田" is associated with the natural accent of the phonemes "yamada", which is a common surname or place name in Japan. The spelling "山" is associated with the accent that is appropriate for a general name representing a mountain and the like. While multiple sets of spellings with different word boundaries are shown in the example in FIG. 8 for convenience of explanation, sets of spellings with the same word boundaries but different phonemes or accents can be found.

The selecting section 420 calculates the probabilities of occurrence in the first corpus 22 of each of the combinations of phonemes and accents corresponding to the retrieved sets of spellings. For example, if the contiguous sequence of words 810*a* and 810*b* occurs nine times and the sequence of words 810*c* and 810*d* occurs once, then the probability of occurrence of the set of word 810*a* and 810*b* is 90%.

Then, the text acquiring section 400 proceeds to processing of the next text to be processed. For example, the text acquiring section 400 selects the spelling "田君は" as a text to be processed 800*b*. The search section 410 searches for a set of spellings containing the word "田君" 810*d* and the word "は" 810*e* and for a set of spellings containing the word "田君" 810*d* and the word "は" 810*f*. Here, words 810*e* and 810*f* are the same in terms of spelling, but they are different in phonemes or accent. Therefore, they are searched for separately. The selecting section 420 calculates the probability of occurrence of the contiguous sequence of words 810*d* and 810*e* and the probability of occurrence of the contiguous sequence of words 810*d* and 810*f*.

Then, the text acquiring section 400 proceeds to processing of the next text to be processed. For example, the text acquiring section 400 selects spelling "君は" as a text to be processed 800*c*. The search section 410 searches for a set of spellings containing the word "君" 810*b* and the word "は" 810*e* and for a set of spellings containing the word "君" 810*b* and the word "は" 810*f*. The selecting section 420 calculates the probability of occurrence of the contiguous sequence of words 810*b* and 810*e* and the probability of occurrence of the contiguous sequence of words 810*b* and 810*f*.

Similarly, the text acquiring section 400 sequentially selects texts to be processed 800*d*, 800*e*, and 800*f*. The selecting section 420 calculates the probabilities of occurrence of combinations of phonemes and accents of each of the sets of spellings that match the spellings in each text to be processed. Finally, the selecting section 420 calculates the product of the probabilities of occurrence of the sets of spellings in each path through which the sets of spellings that match a portion of the input text are selected sequentially. For example, the selecting section 420 calculates the probability of occurrence of the set of words 810*a* and 810*b*, the probability of occurrence of the set of words 810*b* and 810*e*, the probability of occurrence of the set of words 810*e* and 810*g*, and the probability of occurrence of the set of words 810*g* and 810*h* in the path through which it sequentially selects words 810*a*, 810*b*, 810*e*, 810*g*, and 810*h*.

The calculation can be generalized as expression (1)

[Formula 1]

$$M_u(u_1 u_2 \ldots u_h) = \prod_{i-1}^{h+1} P(u_i \mid u_{i-k} \ldots u_{i-2} u_{i-1}) \tag{1}$$

Here, "h" represents the number of sets of spellings, which is 5 in the example shown, and "k" represents the number of words in the context to be examined backward. Since the 2-gram model is assumed in the example shown, k=1. Furthermore, u=<w, t, s, a>. The symbols correspond to those in FIG. 2, where "w" represents a spelling, "t" represents the part of speech, "s" represents a phoneme, and "a" represents an accent.

The selecting section 420 selects the combination of a phoneme and an accent that provides the highest occurrence probability among the probabilities calculated through each path. The selection process can be generalized as equation (2).

[Formula 2]

$$\hat{u} = \mathrm{argmax} M_M(u_1 u_2 \ldots u_h | x_1 x_2 \ldots x_h) \tag{2}$$

Here, "$x_1 x_2 \ldots x_h$" represents the text input by the text acquiring section 400 and each of $x_1, x_2, \ldots x_h$ is characters.

According to the process described above, the speech synthesizing apparatus 40 can compare the context of an input text with the context of a text contained in the first corpus 22 to properly determine the phonemes and accents of the text to be processed.

A process will be described below in which a text to be processed matches a set of spellings including words to be excluded. The search section 410 retrieves a set of spellings containing a word to be excluded 820*a* and a word 810*k* as a set of spellings that match the spellings in a text to be processed 800*g* except for the words to be excluded. Word to be excluded 820*a* actually contains spelling "ABC", which is excluded from the comparison. The search section 410 also detects a set of spellings containing words to be excluded 820*b* and 810*l* as a set of spellings that much the spellings in the text to be processed 800*g* except for the words to be excluded. Word to be excluded 820*b* actually contains the spelling "MNO", which is excluded from the comparison.

The selecting section 420 calculates the probabilities of occurrence of each of the combinations of phonemes and accents of the retrieved sets of spellings including the words to be excluded. For example, the selecting section 420 calculates the probability of the word to be excluded 820*a* and word 810*k* appearing contiguously in this order in the first corpus 22. The selecting section 420 then calculates for the partial text "PQR" corresponding to the words to be excluded, the probabilities in the second corpus 24 of occurrence of each of the combinations of phonemes of the sets of characters retrieved in the characters corresponding to the parts of speech and accents of the words to be excluded. That is, the selecting section 420 uses all words to be excluded, that are nouns and are of accent type X to calculate the probabilities of occurrence of the characters P, Q, and R. The selecting section 420 then calculates the probabilities of occurrence of character strings that contain the contiguous sequence of the characters P and Q in this order. The selecting section 420 also calculates the probabilities of occurrence of character strings that contain the contiguous sequence of the characters Q and R in this order. The selecting section 420 then multiplies each of the occurrence probabilities calculated on the basis of the first corpus 22 by each of the occurrence probabilities calculated on the basis of the second corpus 24.

The selecting section 420 also calculates the probability of occurrence of the word to be excluded 820*b* and word 810*l* appearing contiguously in this order in the first corpus 22. The selecting section 420 then calculates the probabilities of occurrence of the characters P, Q, and R by using all words to be excluded that are verbs and are of accent type Y. The selecting section 420 also calculates the probabilities of occurrence of character strings that contain the contiguous sequence of the characters P and Q in this order. The selecting section 420 also calculates the probabilities of occurrence of character strings that contain the contiguous sequence of the characters Q and R in this order. The selecting section 420 then multiplies each of the probabilities of occurrence calculated on the basis of the first corpus 22 by each of the probabilities of occurrence calculated on the basis of the second corpus 24.

Similarly, the selecting section 420 calculates the probability of occurrence of the word to be excluded 820*a* and word 810*l* appearing contiguously in this order in the first corpus 22. That is, the selecting section 420 calculates the probabilities of occurrence of the characters P, Q, and R by using all words to be excluded that are nouns and are of accent type X. The selecting section 420 then calculates the probabilities of occurrence of character strings that contain the contiguous sequence of the characters P and Q in this order. The selecting section 420 also calculates the probabilities of occurrence of character strings that contain the contiguous sequence of the characters Q and R in this order. The selecting section 420 then multiplies each of the occurrence probabilities calculated on the basis of the first corpus 22 by each of the occurrence probabilities calculated on the basis of the second corpus 24.

Furthermore, the selecting section 420 calculates the probability of occurrence of the word to be excluded 820*b* and word 810*k* appearing contiguously in this order in the first corpus 22. The selecting section 420 then calculates the probabilities of occurrence of the characters P, Q, and R by using all words to be excluded that are verbs and are of accent type Y. The selecting section 420 calculates the probabilities of occurrence of character strings that contain the contiguous sequence of the characters P and Q in this order. The selecting section 420 also calculates the probability of occurrence of character strings that contain the contiguous sequence of the characters Q and R in this order. The selecting section 420 then multiples each of the occurrence probabilities calculated on the basis of the first corpus 22 by each of the occurrence probabilities calculated on the basis of the second corpus 24.

The selecting section 420 selects the combination of a phoneme and accent that has the highest probability of occurrence among the products of the probabilities of occurrence thus calculated. The process can be generalized as:

[Formula 3]

$$P(u_i \mid u_{i-k} \ldots u_{i-2}u_{i-1}) = \begin{cases} P(u_i \mid u_{i-k} \ldots u_{i-2}u_{i-1}) & \text{if } u_i \notin V \\ P(UNK_{(t_i a_j)} \mid u_{i-k} \ldots u_{i-2}u_{i-1}) M_x(u_i \mid \langle t_i, a_j \rangle) & \text{if } u_i \notin V, \end{cases} \quad (3)$$

[Formula 4]

$$M_x(\langle x_1, s_1 \rangle \langle x_2, s_2 \rangle \ldots \langle x_{h'}, s_{h'} \rangle / \langle t, a \rangle) = \prod_{i-1}^{h'+1} P(\langle x_i, s_i \rangle / \langle x_{i-k}, s_{i-k} \rangle \ldots \langle x_{i-1}, s_{i-1} \rangle, \langle t, a \rangle) \quad (4)$$

The selecting section 420 select the accent of a word to be excluded that provides the highest probability of occurrence as the accent of the partial text corresponding to the word to be excluded. For example, if the product of the probability of occurrence of the set of a word to be excluded 820*a* and word 810*k* and the probabilities of occurrence of the characters in the words that are nouns and are accent type X is the highest, then the accent type X of the word to be excluded 820*a* is selected as the accent of the partial text.

As has been described with respect to FIG. 8, the speech synthesizing apparatus 40 can determine the phonemes and accents of the characters in a partial text corresponding to a word to be excluded, even if the text to be processed matches a text containing the word to be excluded. Thus, the speech synthesizing apparatus can provide likely phonemes and accents for various texts as well as texts that perfectly match spellings in the first corpus 22.

Figure 9:
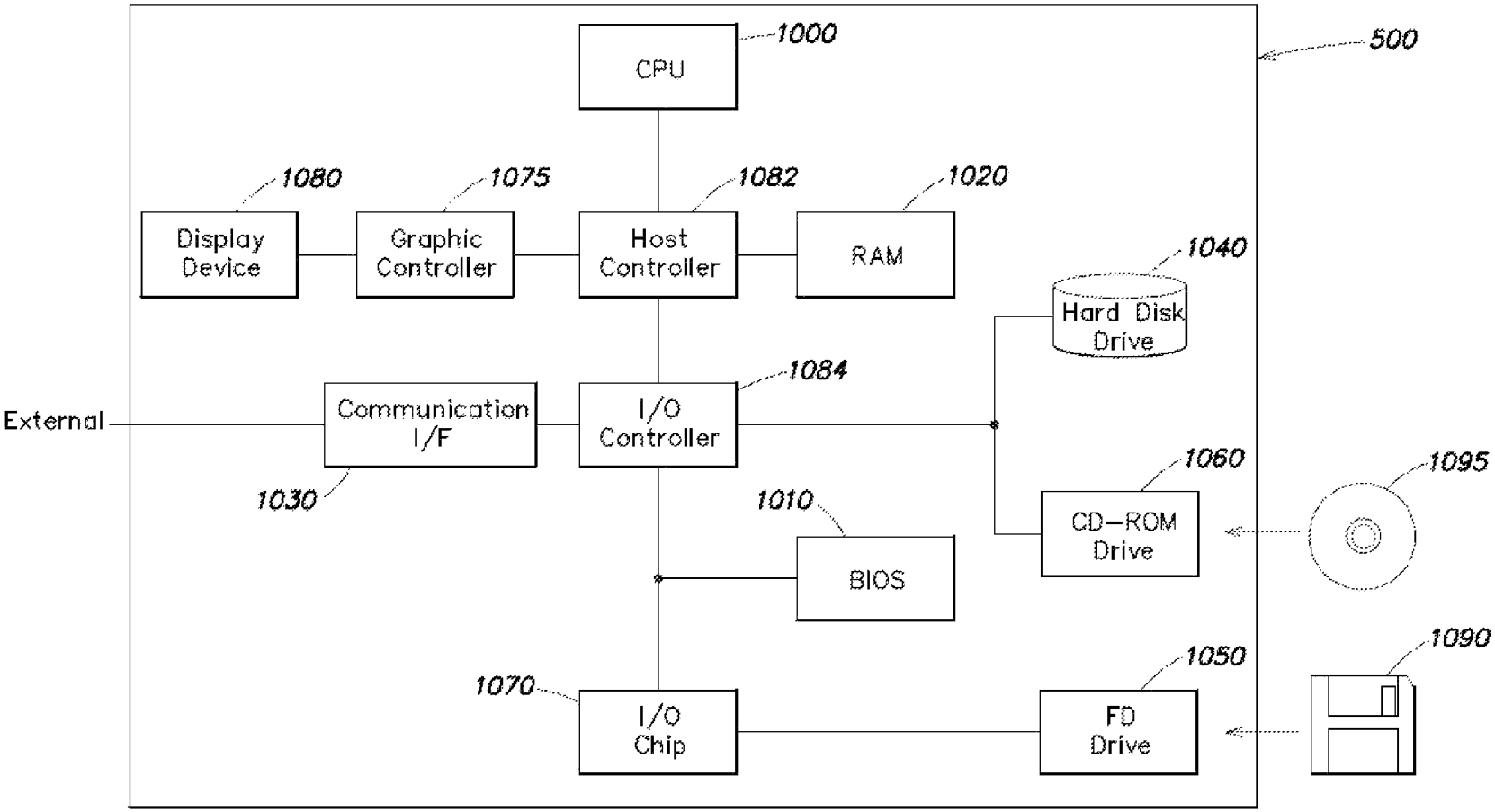
FIG. 9 shows an exemplary hardware configuration of an information processing apparatus which functions as the speech recognition apparatus and the speech synthesizing apparatus.

FIG. 9 shows an exemplary hardware configuration of an information processing apparatus 500 that functions as the speech recognition apparatus 30 and the speech synthesizing apparatus 40. The information processing apparatus 500 includes a CPU section including a CPU 1000, a RAM 1020, and a graphic controller 1075 which are interconnected through a host controller 1082, an input/output section including a communication interface 1030, a hard disk drive 1040, and a CD-ROM drive 1060 which are connected to the host controller 1082 through the input/output controller 1084, and a legacy input/output section including a BIOS 1010, a flexible disk drive 1050, and an input/output chip 1070 which are connected to the input/output controller 1084.

The host controller 1082 connects the CPU 1000 and the graphic controller 1075, which access the RAM 1020 at higher transfer rates, with the RAM 1020. The CPU 1000 operates according to programs stored in the BIOS 1010 and the RAM 1020 to control components of the information processing apparatus 500. The graphic controller 1075 obtains image data generated by the CPU 1000 and the like on a frame buffer provided in the RAM 1020 and causes it to be displayed on a display device 1080. Alternatively, the graphic controller 1075 may contain a frame buffer for storing image data generated by the CPU 1000 and the like.

The input/output controller 1084 connects the host controller 1082 with the communication interface 1030, the hard disk drive 1040, and the CD-ROM drive 1060, which are relatively fast input/output devices. The communication interface 1030 communicates with external devices through a network. The hard disk drive 1040 stores programs and data used by the information processing apparatus 500. The CD-ROM drive 1060 reads a program or data from a CD-ROM 1095 and provides it to the RAM 1020 or the hard disk drive 1040.

Connected to the input/output controller 1084 are the BIOS 1010 and relatively slow input/output devices such as the flexible disk drive 1050, and the input/output chip 1070. The BIOS 1010 stores a boot program executed by the CPU 1000 during boot-up of the information processing apparatus 500, programs dependent on the hardware of the information processing apparatus 500 and the like. The flexible disk drive 1050 reads a program or data from a flexible disk 1090 and provides it to the RAM 1020 or the hard disk drive 1040 through the input/output chip 1070. The input/output chip 1070 connects the flexible disk 1090, and various input/output devices through ports such as a parallel port, serial port, keyboard port, and mouse port, for example.

A program to be provided to the information processing apparatus 500 is stored on a recording medium such as a flexible disk 1090, a CD-ROM 1095, or an IC card and provided by a user. The program is read from the recording medium and installed in the information processing apparatus 500 through the input/output chip 1070 and/or input/output controller 1084 and executed. Operations performed by the information processing apparatus 500 and the like under the control of the program are the same as the operations in the speech recognition apparatus 30 and the speech synthesizing apparatus 40 described with reference to FIGS. 1 to 8 and therefore the description of them will be omitted.

The programs mentioned above may be stored in an external storage medium. The storage medium may be a flexible disk 1090 or a CD-ROM 1095, or an optical recording medium such as a DVD and PD, a magneto-optical recording medium such as an MD, a tape medium, or a semiconductor memory such as an IC card. Alternatively, a storage device such as a hard disk or a RAM provided in a server system connected to a private communication network or the Internet may be used as the recording medium and the program may be provided from the storage device to the information processing apparatus 500 over the network.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various While the present invention has been descried with respect to embodiments thereof, the technical scope of the present invention is not limited to that described with the embodiments. It will be apparent to those skilled in the art that various modifications or improvements can be made to the embodiments. It will be apparent from the description the claims that embodiments to which such modifications and improvements are made also fall within the scope of the technical scope of the present invention.

The invention claimed is:

1. A computer-implemented method for processing an input text, the input text comprising an input character string, the method comprising acts of:

identifying a first segmentation of the input character string, the first segmentation forming a first candidate sequence of words corresponding to the input character string, wherein the first candidate sequence of words comprises at least one first word having at least one character and a first pronunciation;

determining, based at least in part on statistical information regarding phonemes and/or accents for pronouncing character strings, a first occurrence probability for the first candidate sequence of words, wherein the statistical information comprises information indicative of a frequency at which the at least one character is associated with the first pronunciation;

identifying a second segmentation of the input character string, the second segmentation being different from the first segmentation and forming a second candidate sequence of words corresponding to the input character string, wherein the second candidate sequence of words comprises at least one second word having the same at least one character as the first word but a second pronunciation that is different from the first pronunciation of the first word;

determining, based at least in part on the statistical information regarding phonemes and/or accents for pronouncing character strings, a second occurrence probability for the second candidate sequence of words, wherein the statistical information further comprises information indicative of a frequency at which the at least one character is associated with the second pronunciation; and selecting, based at least in part on the first and second occurrence probabilities, a selected sequence of words from a plurality of candidate sequences of words comprising the first and second candidate sequences of words.

2. The computer-implemented method of claim 1, wherein the input text is in a language in which word boundaries are not explicitly indicated.

3. The computer-implemented method of claim 1, wherein at least one word in the selected sequence of words comprises at least one character string for the at least one word and pronunciation information for the at least one character string.

4. The computer-implemented method of claim 3, wherein the pronunciation information for the at least one character string comprises a combination of at least one phoneme and at least one accent for the at least one character string, and wherein the method further comprises:

using the pronunciation information to generate synthetic speech corresponding to the input character string.

5. The computer-implemented method of claim 3, wherein the at least one word further comprises part of speech information for the at least one character string.

6. The computer-implemented method of claim 1, wherein the statistical information regarding phonemes and/or accents for pronouncing character strings comprises an occurrence probability for a combination of at least one phoneme and at least one accent for at least one character string.

7. The computer-implemented method of claim 6, wherein the occurrence probability for the combination of the at least one phoneme and the at least one accent for the at least one character string is conditioned upon the at least one character string occurring in a particular context, the particular context comprising one or more particular words preceding the at least one character string and/or one or more particular words following the at least one character string.

8. The computer-implemented method of claim 1, wherein the selected sequence of words is the first candidate sequence of words, and wherein the first candidate sequence of words is selected at least in part because the first occurrence probability is higher than the second occurrence probability.

9. The computer-implemented method of claim 1, wherein the selected sequence of words is the first candidate sequence of words, and wherein the first candidate sequence of words is selected at least in part because the first occurrence probability is higher than a reference probability.

10. The computer-implemented method of claim 1, wherein the at least one first word is preceded in the first candidate sequence of words by at least one third word, and wherein the frequency at which the at least one character is associated with the first pronunciation comprises a frequency at which the at least one character is associated with the first pronunciation given that the at least one character is preceded by the at least one third word.

11. A computer system for processing an input text, the input text comprising an input character string, the computer system comprising at least one processor programmed to:

identify a first segmentation of the input character string, the first segmentation forming a first candidate sequence of words corresponding to the input character string, wherein the first candidate sequence of words comprises at least one first word having at least one character and a first pronunciation;

determine, based at least in part on statistical information regarding phonemes and/or accents for pronouncing character strings, a first occurrence probability for the first candidate sequence of words, wherein the statistical information comprises information indicative of a frequency at which the at least one character is associated with the first pronunciation;

identify a second segmentation of the input character string, the second segmentation being different from the first segmentation and forming a second candidate sequence of words corresponding to the input character string, wherein the second candidate sequence of words comprises at least one second word having the same at least one character as the first word but a second pronunciation that is different from the first pronunciation of the first word;

determine, based at least in part on the statistical information regarding phonemes and/or accents for pronouncing character strings, a second occurrence probability for the second candidate sequence of words, wherein the statistical information further comprises information indicative of a frequency at which the at least one character is associated with the second pronunciation; and select, based at least in part on the first and second occurrence probabilities, a selected sequence of words from a plurality of candidate sequences of words comprising the first and second candidate sequences of words.

12. The computer system of claim 11, wherein the input text is in a language in which word boundaries are not explicitly indicated.

13. The computer system of claim 11, wherein at least one word in the selected sequence of words comprises at least one character string for the at least one word and pronunciation information for the at least one character string.

14. The computer system of claim 13, wherein the pronunciation information for the at least one character string comprises a combination of at least one phoneme and at least one accent for the at least one character string, and wherein the at least one processor is further programmed to:

use the pronunciation information to generate synthetic speech corresponding to the input character string.

15. The computer system of claim 13, wherein the at least one word further comprises part of speech information for the at least one character string.

16. The computer system of claim 11, wherein the statistical information regarding phonemes and/or accents for pronouncing character strings comprises an occurrence probability for a combination of at least one phoneme and at least one accent for at least one character string.

17. The computer system of claim 16, wherein the occurrence probability for the combination of the at least one phoneme and the at least one accent for the at least one character string is conditioned upon the at least one character string occurring in a particular context, the particular context comprising one or more particular words preceding the at least one character string and/or one or more particular words following the at least one character string.

18. The computer system of claim 11, wherein the selected sequence of words is the first candidate sequence of words, and wherein the first candidate sequence of words is selected at least in part because the first occurrence probability is higher than the second occurrence probability.

19. The computer system of claim 11, wherein the selected sequence of words is the first candidate sequence of words, and wherein the first candidate sequence of words is selected at least in part because the first occurrence probability is higher than a reference probability.

20. The computer system of claim 11, wherein the at least one first word is preceded in the first candidate sequence of words by at least one third word, and wherein the frequency at which the at least one character is associated with the first pronunciation comprises a frequency at which the at least one character is associated with the first pronunciation given that the at least one character is preceded by the at least one third word.

21. An article of manufacture comprising a computer-readable storage medium encoded with computer code for execution on at least one processor in a system, the computer code, when executed on the at least one processor, performing a method for processing an input text, the input text comprising an input character string, the method comprising acts of:

identifying a first segmentation of the input character string, the first segmentation forming a first candidate sequence of words corresponding to the input character string, wherein the first candidate sequence of words comprises at least one first word having at least one character and a first pronunciation;

determining, based at least in part on statistical information regarding phonemes and/or accents for pronouncing character strings, a first occurrence probability for the first candidate sequence of words, wherein the statistical information comprises information indicative of a frequency at which the at least one character is associated with the first pronunciation;

identifying a second segmentation of the input character string, the second segmentation different from the first segmentation and forming a second candidate sequence of words corresponding to the input character string, wherein the second candidate sequence of words comprises at least one second word having the same at least one character as the first word but a second pronunciation that is different from the first pronunciation of the first word;

determining, based at least in part on the statistical information regarding phonemes and/or accents for pronouncing character strings, a second occurrence probability for the second candidate sequence of words, wherein the statistical information further comprises information indicative of a frequency at which the at least one character is associated with the second pronunciation; and selecting, based at least in part on the first and second occurrence probabilities, a selected sequence of words from a plurality of candidate sequences of words comprising the first and second candidate sequences of words.

22. The article of manufacture of claim 21, wherein the input text is in a language in which word boundaries are not explicitly indicated.

23. The article of manufacture of claim 21, wherein at least one word in the selected sequence of words comprises at least one character string for the at least one word and pronunciation information for the at least one character string.

24. The article of manufacture of claim 23, wherein the pronunciation information for the at least one character string comprises a combination of at least one phoneme and at least one accent for the at least one character string, and wherein the method further comprises:

using the pronunciation information to generate synthetic speech corresponding to the input character string.

25. The article of manufacture of claim 23, wherein the at least one word is further associated with part of speech information for the at least one character string.

26. The article of manufacture of claim 21, wherein the statistical information regarding phonemes and/or accents for pronouncing character strings comprises an occurrence probability for a combination of at least one phoneme and at least one accent for at least one character string.

27. The article of manufacture of claim 26, wherein the occurrence probability for the combination of the at least one phoneme and the at least one accent for the at least one character string is conditioned upon the at least one character string occurring in a particular context, the particular context comprising one or more particular words preceding the at least one character string and/or one or more particular words following the at least one character string.

28. The article of manufacture of claim 21, wherein the selected sequence of words is the first candidate sequence of words, and wherein the first candidate sequence of words is selected at least in part because the first occurrence probability is higher than the second occurrence probability.

29. The article of manufacture of claim 21, wherein the selected sequence of words is the first candidate sequence of words, and wherein the first candidate sequence of words is selected at least in part because the first occurrence probability is higher than a reference probability.

30. The article of manufacture of claim 21, wherein the at least one first word is preceded in the first candidate sequence of words by at least one third word, and wherein the frequency at which the at least one character is associated with the first pronunciation comprises a frequency at which the at least one character is associated with the first pronunciation given that the at least one character is preceded by the at least one third word.

* * * * *